United States Patent [19]

Foster

[11] Patent Number: 4,798,106

[45] Date of Patent: Jan. 17, 1989

[54] CHAMPAGNE BOTTLE CORK PULLER AND INSERTING APPARATUS

[76] Inventor: Milton E. Foster, 2735 Almendra Ct., Fallbrook, Calif. 92028

[21] Appl. No.: 941,206

[22] Filed: Dec. 12, 1986

[51] Int. Cl.[4] ..... B67B 7/02

[52] U.S. Cl. ..... 81/3.29; 29/256

[58] Field of Search ..... 81/3.29, 3.07, 3.36, 81/3.37; 29/266, 256

[56] References Cited

U.S. PATENT DOCUMENTS

| | | | |
|---|---|---|---|
| 2,761,338 | 9/1956 | Hardy | 81/3.29 |
| 3,800,345 | 4/1974 | Feliz | 81/3.37 |
| 4,406,182 | 9/1983 | Antone | 29/266 |
| 4,527,450 | 7/1985 | Dorsky | 81/3.37 |
| 4,590,821 | 5/1986 | Olson | 81/3.29 |
| 4,598,613 | 7/1986 | Baum | 81/3.37 |

*Primary Examiner*—Roscoe V. Parker

*Attorney, Agent, or Firm*—Poms, Smith, Lande & Rose

[57] ABSTRACT

A champagne bottle cork puller and insertion apparatus for controllably pulling and inserting a champagne cork. The apparatus includes a cork engager, an engager raising and lower device, and a single piece body which is attached to the raising and lowering device. The body includes a groove which fits around a champagne bottle spout rim and keeps the body essentially vertically immovable with respect to the champagne bottle during operation. The apparatus includes relatively few parts and is inexpensive to manufacture and assemble.

4 Claims, 2 Drawing Sheets

CHAMPAGNE BOTTLE CORK PULLER AND INSERTING APPARATUS

FIELD OF THE INVENTION

This invention relates generally to devices for removing and inserting bottle tops and, in particular, to devices for removing and inserting champagne bottle corks.

BACKGROUND OF THE INVENTION

Champagne is typically stored under high pressure in bottles with tightly inserted corks. In removing the corks, the pressure inside the bottle is often so great that the cork, upon being removed, is propelled into the air and, despite care, occasionally causes personal injury such as injury to a person's eye.

The most common method used by people to remove champagne corks is by pressing their thumbs upward against the corks. This can cause personal discomfort and there is little control in keeping the cork from being projected into the air.

Mechanical devices have been provided for removing wine bottle corks. One type of device drills a helical hook into the wine bottle cork. Such devices are inadequate for champagne bottle corks because champagne corks are often made of plastic and are difficult to drill into. In addition, drilling a hole into the plastic cork will make it unreusable, and may allow champagne to spray out of the drilled hole before the cork has been removed.

One device for removing champagne bottle corks is described in U.S. Pat. No. 4,406,182 to Howard J. Antone. A review of the Antone patent indicates that the device is somewhat complex. It uses three shafts and three frames. Manufacturing and assembling these shafts and frames is more expensive and time consuming than would manufacturing and assembling a device involving fewer parts. In addition, the combination of shafts and frames is generally unappealing aesthetically. Moreover, the Antone device, because of the metal plates which grip the champagne bottle, is highly likely to chip the bottle when the cork is extracted. The Antone device also does not protect the user from any spray that exits the bottle as the cork is being removed.

It is therefore an object of the present invention to provide a device for controllably pulling a champagne bottle cork.

It is a further object of the invention to provide a device for controllably re-inserting the champagne bottle cork into the bottle after opening.

It is yet another object of the invention that the device use a minimum number of parts and thus be relatively inexpensive to manufacture and assemble.

SUMMARY OF THE INVENTION

The present invention, in a broad aspect, is an apparatus for pulling and reinserting a champagne bottle cork. The apparatus includes a cork engager, an engager raising and lowering device, and a single piece body. The body includes a groove which fits around a champagne bottle rim and keeps the body essentially vertically immovable with respect to the champagne bottle during operation. The body is made of plastic, which will prevent chipping of the bottle when it is used.

The cork engager includes first and second openings. The first opening will admit the upper portion of a cork. The second opening, which is defined by a ridge, will not allow the upper portion of the cork to pass through it but will allow the step of the cork to pass through it. Thus, in operation, when the cork engager is raised, the upper portion of the cork will be pulled up by the ridge defining the second opening.

Other objects, features and advantages of the present invention will become apparent from consideration of the following description and from the accompanying drawings.

DETAILED DESCRIPTION

Figure 1:
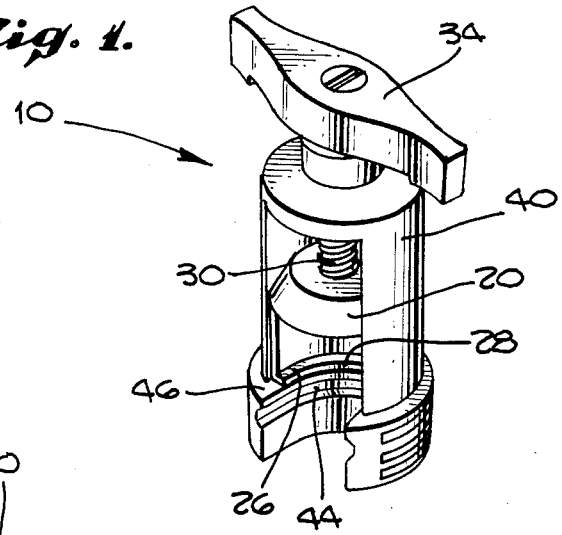
FIG. 1 shows a perspective view of the cork puller and insertion apparatus according to the present invention.

The champagne bottle cork puller and inserting apparatus 10 according to the invention is shown in FIG. 1. The major portions of apparatus 10 are cork engager 20, raising and lowering device 30, and body 40.

Figure 2:
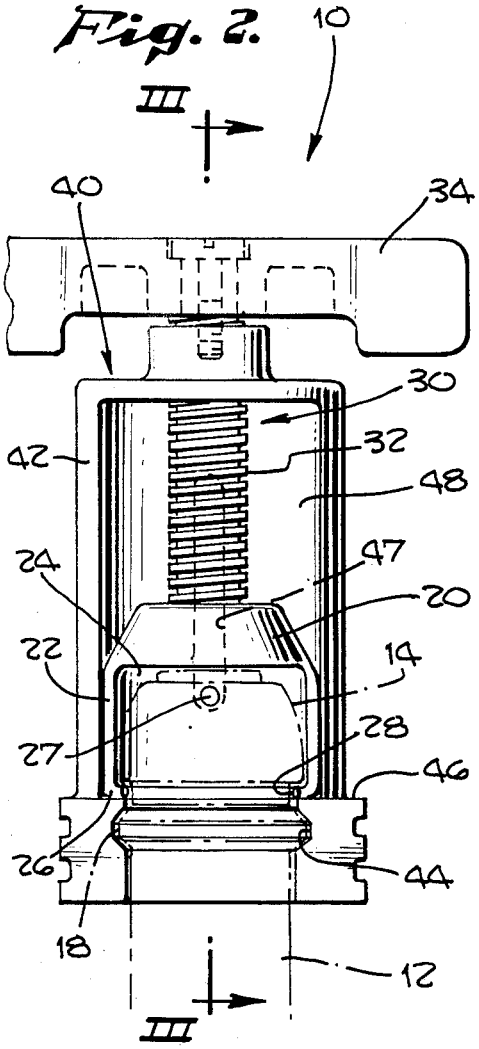
FIG. 2 shows a front view of the apparatus shown in FIG. 1 shown in position with a champagne bottle.
Figure 3:
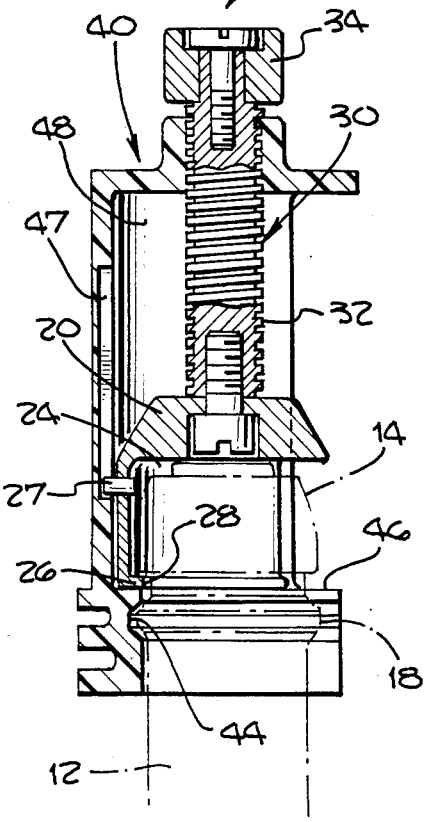
FIG. 3 shows a side view of the apparatus as shown in FIG. 2 taken through the plane III—III.
Figure 4:
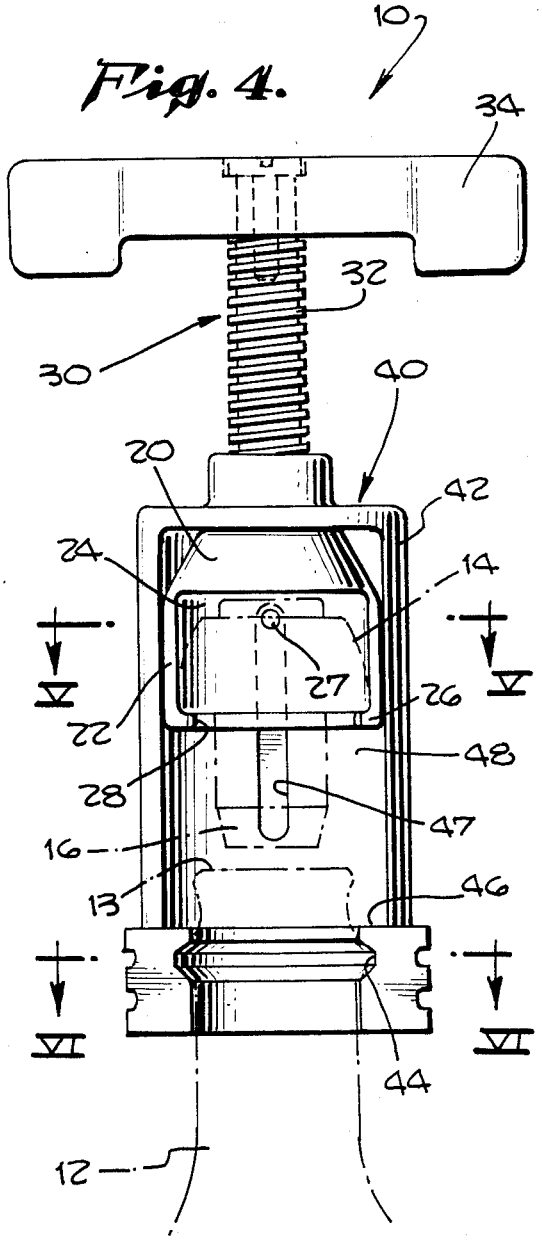
FIG. 4 shows the apparatus shown in FIG. 1 with the cork removed from the bottle.
Figure 5:
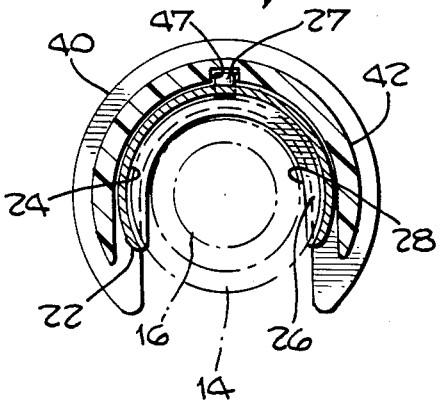
FIG. 5 shows a bottom view of the apparatus as shown in FIG. 4, taken through the plane V—V.
Figure 6:
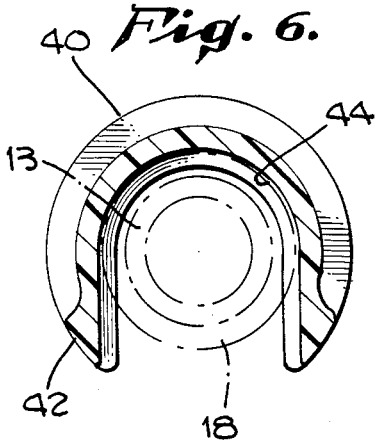
FIG. 6 shows a bottom view of the apparatus as shown in FIG. 4 taken through plane VI—VI.
Figure 7:
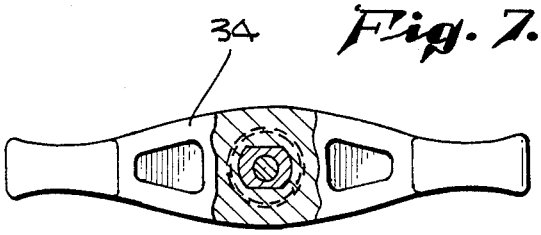
FIG. 7 shows the handle portion of the apparatus according to FIG. 1.

The apparatus 10 is shown in operating position with champagne bottle 12 and cork 14 in FIG. 2. Cork engager 20 includes a semi-cylindrically shaped shell 22 which defines an opening 24 large enough to admit the upper or head portion of cork 14 as shown in FIGS. 2, 3 and 4. The shell includes ridge 26 at the bottom. Ridge 26 defines a bottom opening 28 (See FIG. 6) large enough to admit champagne cork stem 16 (See FIG. 4) but not large enough to allow the upper portion of cork 14 to pass through it.

Raising and lowering device 30 includes screw 32 and handle 34. Handle 34 is molded to or mechanically attached by screw or the like to screw 32. Screw 32 is attached to cork engager 20, and is threaded through body 40 as shown in FIGS. 2, 3 and 4. Cork engager 20 is lowered by turning handle 34 clockwise, and raised by turning handle 34 counterclockwise.

Body 40 consists of a single piece of plastic material. Body 40 includes semi-cylindrically shaped shell 42, ridge 46, groove 44. The semicylindrical shape of the body facilitates the use of the device by allowing the user to comfortably grasp the body when attached to a champagne bottle while the device is being operated. The shape of the body also prevents any spray from the bottle from contacting the user. The body can also be quickly rotated to catch any spray coming beneath the portion of the cork adjacent the open portion of the body. The use of plastic to form the shell 42 is advantageous because it can be made with the appropriate resilience to firmly engage the neck of the champagne bottle. The use of plastic also prevents chipping of the champagne bottle neck when the bottle is engaged.

Shell 42 defines a slot 47 for pin 27 connected to engager 20. Pin 27 is slidably movable within the slot 47. Body 40 is designed to be comfortably held in the hand.

In operation, cork engager 20 is lowered to approximately where ridge 26 touches ridge 46. The exact location may vary depending on what type of champagne bottle is used. Next, spout 13 of champagne bottle 12 and cork 14 are inserted into opening 48.

If cork engager 20 is lowered to the correct location, the upper portion of cork 14 will fit into engager 20. Groove 44 is adapted to fit relatively all champagne bottles. Therefore, body 40 will not move vertically with respect to bottle 12 during operation. Alternatively, the engager 20 may be provided with a gate (not shown) to maintain nonstandard corks.

With bottle 12 and cork 14 in place as described above, the user turns handle 34 counterclockwise which causes engager 20 to be raised. Ridge 26 pulls upward against the portion of cork 14 which extends radially outward beyond bottle 12 which causes cork 14 to be controllably pulled from the spout of bottle 12. The user continues to turn handle 34 until cork 14 is completely removed from bottle 12 as is shown in FIG. 4.

With cork 14 removed, groove 44 is slid away from bottle spout rim 18. Cork 14 can be manually removed from engager 20, or be left in engager 20 until reinsertion is desired.

The process of inserting cork 14 into bottle 12 is just the opposite of the process described above. With engager 20 fully raised as shown in FIG. 4, cork 14 is inserted in engager 20. Groove 44 is then slid around spout rim 18. Stem 16 is then controllable inserted into bottle 12 as handle 34 is turned clockwise.

The elements of the invention can be manufactured and assembled in a way which will be readily apparent to one of ordinary skill. Body 40 is preferably made of molded plastic. The relatively small number of parts of this invention makes it inexpensive to manufacture and assemble. In addition, the semi-cylindrical shape of single piece connector 40 is visually appealing.

In the foregoing description of the present invention, a preferred embodiment has been disclosed. It is to be understood that the various design variations are within the scope of the present invention and that the present invention is not limited to the particular arrangements which have been illustrated and described herein.

What is claimed is:

1. A champagne bottle cork puller and inserting apparatus comprising:

engaging means for engaging a champagne bottle cork, said engaging means including a semicircular shell defining a first opening adapted to engage the head of said cork, said shell also including a ridge defining a second opening adapted to engage the stem portion of said cork, and pin means, attached to said engaging means and adapted to slide along a body means, for maintaining said first and second openings exposed;

means, concentrically positioned and attached to said engaging means, for raising and lowering said engaging means; and body means for engaging said bottle and said raising and lowering means, said body means including a single part body including a groove which is adapted to securely fit around a champagne spout rim.

2. A champagne bottle cork puller and inserting apparatus as defined in claim 1, wherein said raising and lowering means comprises:

screw means threadingly engaging said body means; and handle means attached through said screw means to said body means.

3. A champagne bottle cork puller and inserting apparatus as defined in claim 1, wherein said body means is made of molded plastic.

4. A champagne bottle cork puller and inserting apparatus as defined in claim 1, wherein said body means further comprises:

an outer rib formed along an outer surface of said body means where said body means engages said bottle;

said outer rib providing a reinforced structure to said body means.

* * * * *